US005407164A

United States Patent [19]

Quinn

[11] Patent Number: 5,407,164

[45] Date of Patent: Apr. 18, 1995

[54] HOLDER FOR A WINDOW SILL

[76] Inventor: Joseph F. Quinn, 9 Fells Cir., Wellesley, Mass. 02181

[21] Appl. No.: 167,706

[22] Filed: Dec. 15, 1993

[51] Int. Cl.[6] ..... A47G 29/00

[52] U.S. Cl. ..... 248/316.7; 362/392; 362/393; 362/396; 248/479; 248/208

[58] Field of Search ..... 248/214, 316.7, 505, 248/499, 208; 362/392, 393, 810, 125, 190, 191, 396

[56] References Cited

U.S. PATENT DOCUMENTS

| | | | |
|---|---|---|---|
| 1,037,096 | 8/1912 | Wood | 362/396 X |
| 1,073,013 | 9/1913 | Andres | 362/396 X |
| 1,431,485 | 10/1922 | Peck | 362/396 X |
| 1,586,244 | 5/1926 | Hermann | 362/396 |
| 1,838,734 | 12/1931 | Beecher | 362/810 X |
| 1,863,988 | 6/1932 | Kupter | 248/208 |
| 2,465,700 | 3/1949 | Tuttle | 362/810 X |
| 2,536,901 | 1/1951 | Bearden | 248/208 |
| 3,027,014 | 3/1962 | Lindblom | 248/214 X |
| 3,061,331 | 10/1962 | Lantis | 248/499 X |
| 3,340,390 | 9/1967 | Imre | 362/396 X |
| 3,729,778 | 5/1973 | McGrath | 248/499 X |
| 3,989,213 | 11/1976 | Allen | 248/214 |
| 4,198,020 | 4/1980 | Walker et al. | 248/499 X |
| 4,392,191 | 7/1983 | White, Sr. | 362/396 X |
| 5,199,781 | 4/1993 | Sweeney | 362/392 X |

*Primary Examiner*—Ira S. Lazarus
*Assistant Examiner*—Thomas M. Sember
*Attorney, Agent, or Firm*—Herbert L. Bello

[57] ABSTRACT

A holder in the form of a J-shaped clip having an upper supporting portion, an intermediate portion and a lower gripping portion for mounting to window sills of various thicknesses between the upper portion and lower portion. The upper portion defines a platform for supporting an object having a protruding base such as an electric candle or plant pot and saucer assembly. A pair of upturned tabs are provided at opposite corners of the upper portion and a lip is formed in the intermediate portion. A resilient cord fastened to the upper portion and received in the lip holds the base of the object to be displayed on the upper portion. The upper portion and the lower portion grip the window sill and secure the holder thereto.

10 Claims, 6 Drawing Sheets

HOLDER FOR A WINDOW SILL

BACKGROUND OF THE INVENTION

1. Field of the Invention

The present invention relates to holding devices and more particularly, is directed towards a holder for supporting candles, plant pots and the like on window sills, ledges and the like.

2. Description of the Prior Art

Electric candles, plant pots and the like are displayed in windows at various times of the year. A common problem with displaying candles and plant pots in windows is that it is difficult to adequately support them on the window sill. Attempts to secure candles to window sills include the use of adhesive tape and/or thumb tacks. Adhesive tape suffers from the disadvantages that it may leave marks on the window sill and/or remove some of the paint or stain. Also, adhesive tape may become loose due to condensation. Thumb tacks suffer from the disadvantage that they leave holes in the window sills. Other devices for holding candles on window sills are shown in U.S. Pat. Nos. 4,392,191 and 4,468,721. A need has arisen for a window sill clip for holding candles, plant pots and the like which does not suffer from the heretofore mentioned disadvantages and limitations.

SUMMARY OF THE INVENTION

It is an object of the present invention to provide a holder for supporting candles, plant pots and the like on window sills, ledges and the like which does not suffer from the heretofore mentioned disadvantages and limitations.

It is another object of the present invention to provide a holder which is attachable to ledges and window sills of different thicknesses for displaying candles, plant pots and the like.

It is a further object of the present invention to provide a holder which is easily attached to ledges and window sills of various thicknesses and which does not mark either the window sill or the ledge.

The holder of the present invention is characterized by a unitized J-shaped clip having an upper portion, an intermediate portion and a lower portion. The holder is configured to grip window sills and ledges of various thicknesses between the upper portion and lower portion of the holder. The upper portion of the holder defines a platform for supporting an object having a protruding base, such as an electric candle or plant pot and saucer assembly. Opposite corners of the upper portion of the holder are turned upwardly and form a pair of fastening tabs. Opposite ends of a resilient cord are attached to the fastening tabs. A lip is formed in the intermediate portion of the holder for captively holding an intermediate portion of the resilient cord. The protruding base of the object to be displayed is held on the upper portion of the holder by the resilient cord which is pulled over the base and locked into the lip.

Other objects of the present invention will in part be obvious and will in part appear hereinafter.

The invention accordingly comprises the apparatuses, processes and products, together with their parts, steps, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
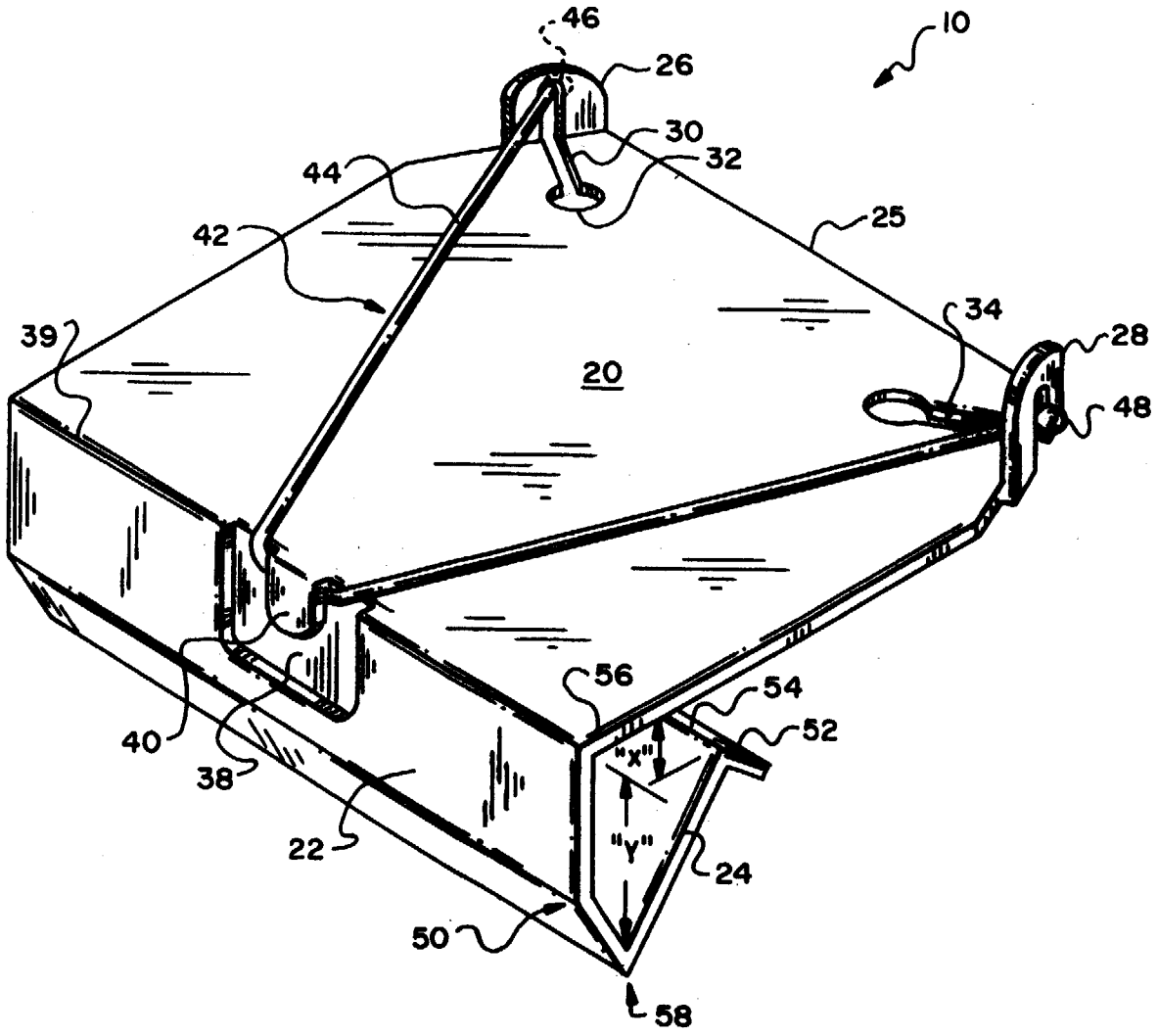
FIG. 1 is a perspective view of a holder embodying the present invention for holding objects on a window sill or ledge for display.

Referring now to the drawings, particularly FIG. 1, there is shown a holder 10 embodying the invention for holding an object having a base, such as a candle 12 (FIG. 2) or a container 14, for example a plant pot and saucer assembly 14 (FIG. 3), on a window sill 16. Holder 10 is a one-piece, substantially J-shaped member 18 in the form of a clip having an upper platform or supporting member 20, an intermediate member 22, and a lower gripping member 24. The upper portion 20 and the intermediate portion 22 are substantially perpendicular to one another, the lower gripping member 24 being under upper portion 20.

In the preferred embodiment, holder 10 is composed of a plastic or metal which has sufficient elasticity so that it can be temporarily bent within its elastic limits to accommodate window sills of various thicknesses and return towards its original configuration to grip the window sill between the upper platform 20 and the lower gripping member 24 without being permanently deformed. In the preferred embodiment, the material of which holder 10 is composed of has a tensile yield strength of at least 9,000 psi; a flexural strength (rupture or yield) of at least 13,000 psi; a tensile modulus of at least 345,000 psi; and a flexural modulus at seventy-three degrees fahrenheit of at least 340,000 psi. Preferably, holder 10 is composed of a plastic such as polycarbonate. Holder 10 can be fabricated using a variety of methods including stamping, molding, extruding and the like.

In the illustrated embodiment, holder 10 is sheet of polycarbonate that is bent into the substantially J-shaped clip shown in FIG. 1. The corners of the outermost edge 25 of the platform 20 are upturned to form fastening tabs 26 and 28. A slot 30 having an enlarged circular opening 32 at one end is provided in platform 20 adjacent tab 26, the slot extending into tab 26. Similarly, a slot 34 having an enlarged circular opening 36 at one end is provided in platform 20 adjacent tab 28, the slot extending into tab 28.

An opening 38, for example a substantially C-shaped opening, is formed in the upper middle portion of intermediate member 22. A retainer or lip 40 extends downwardly from the uppermost edge 39 of platform 20 into opening 38. As hereinafter described, a stretchable member 42, which is used to secure an object on platform 20, is held by tabs 26, 28 and lip 40.

In the illustrated embodiment, stretchable member 42 is a stretchable elastic cord 44 having a knob 46, for example a ball-shaped knob, at one end and a knob 48, for example a ball-shaped knob, at its other end. The diameter of ball 46 is smaller than the diameter of opening 32 and larger than the width of slot 30. Therefore, when ball 46 is inserted into opening 32 and moved along slot 30 until it rests behind tab 26, ball 46 is held in place when cord 44 is stretched as shown in FIG. 1. Similarly, the diameter of ball 48 is smaller than the opening 36 and larger than the width of slot 34. Accordingly, when ball 48 is pushed through opening 36 and pulled through slot 34 until it is positioned behind tab 28, ball 48 is held in place when cord 44 is stretched as shown in FIG. 1. Cord 44 is stretched and pulled away from tabs 46,48 and looped over lip 40 to hold the object on platform 20. The length of cord 44 when it is in a relaxed state and not stretched is less than the sum of the distance between tab 26 and lip 40 and the distance between tab 28 and lip 40. Preferably, chord 44 has an elasticity of approximately 6.25 ounces per inch elongation and an elongation of thirty-five to forty percent of its free length.

The lower marginal portion of intermediate member 22 is bent inwardly at 50 so that gripping member 24 is turned upwardly toward the underside of platform 20. The marginal free end of gripping member 24 is bent forwardly and downwardly to form an enlarged guideway or caming surface 52 and a gripping means 54, for example a pointed ridge. It is to be understood that, in an alternate embodiment, gripping means 54 is other than a pointed ridge, for example, a ridge with a radius. A distance "X" between ridge 54 and the underside of platform 20 is less that the thickness of window sill 16. Typically, the distance "X" between ridge 54 and the underside of platform 20 is between ¼" to ½" when holder 10 is in its relaxed or preformed configuration. Typically, a distance "Y" between a corner 56 of the intersection of platform 20 and intermediate section 20, and a corner 58 at the intersection of intermediate section 22 and lower gripping member 24 is between ¾" and 1¼". In the preferred embodiment illustrated in FIG. 1, the distance "X" is ⅜" and the distance "Y" is 1".

Figure 2:
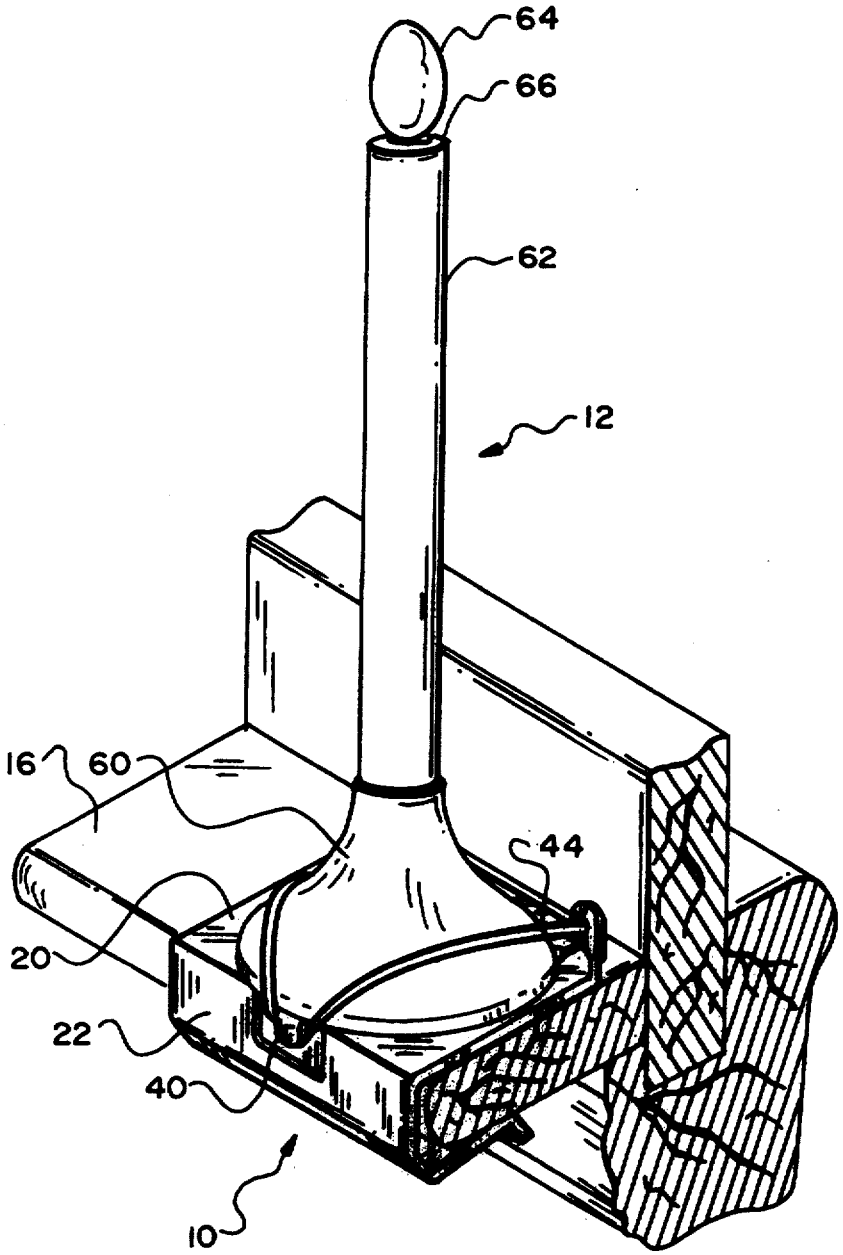
FIG. 2 is a perspective view of the holder of FIG. 1 supporting an electric candle on a window sill.
Figure 3:
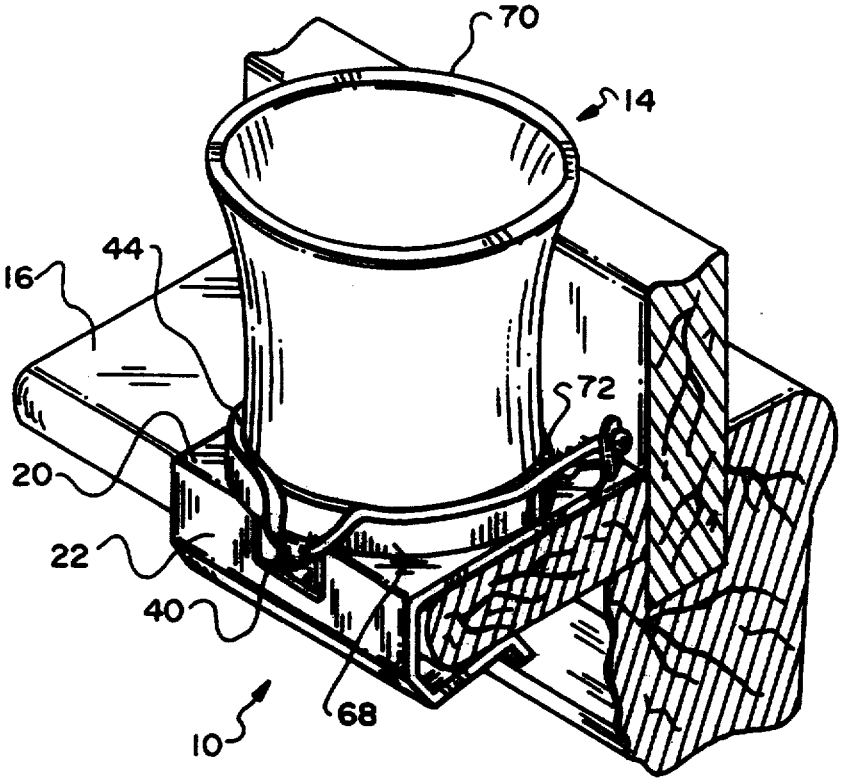
FIG. 3 is a perspective view of the holder of FIG. 1 supporting a plant pot on a window sill.

When holder 10 is in its relaxed or preformed configuration, ridge 54 is closest to platform 20 and guideway 52 is in its smallest or most closed position. In order to accommodate window sills of various thicknesses, guideway 52 opens as holder 10 is pushed onto window sill 16 as shown in FIGS. 2 and 3. Guideway 52 opens so that the distance between ridge 54 and the underside of platform 20 increases to accommodate the thickness of window sill 16. Although it is possible to open guideway 52 so that the distance between ridge 54 and the underside of platform 20 is greater than the distance "Y", it is preferred that the thickness of the window sill is less than the distance "Y" as shown in FIGS. 2 and 3.

Referring now to FIG. 2, it will be seen that candle 12 is attached to holder 10 by means of stretchable member 42. Candle 12 includes a protruding base 60, a candle body 62 and a light source 64, for example a light bulb. The lower end of candle body 62 is secured to base 60 and light bulb 64 is received in a socket 66 in the upper end of the candle body. Base 60 extends outwardly of candle body 62 and provides a surface for stretchable member 42 to pass across for securing candle 12 to holder 10. Candle 12 can be attached to holder 10 either before or after the holder is pushed onto window sill 16. In either case, preferably, cord 44 is secured to tabs 26, 28 and held thereto by knobs 46 and 48. It is to be understood that, in alternate embodiments the ends of cord 44 are held to tabs 26,28 by means other than slots 30, 34 and knobs 46, 48. For example, the ends of cord 44 are secured to tabs 26,28 or to the outer corners of platform 20 by means of a fastening device such as a screw or the ends of the cord are attached by an adhesive or the ends of the cord are passed through a small opening and a knot is tied in the ends of the cord. With cord 44 released from lip 40, base 60 is passed through the loop formed cord 44, the ends of the cord being secured in tabs 26,28. Then, cord 44 is stretched and passed under lip 40, the cord lying across the upper surface of the base 60. Candle 12 is now held to holder 10. Candle 12 is easily removed from holder 10 by releasing cord 44 from lip 40 and pulling the candle out of the grip of the cord. Plant pot 14 is held to holder 10 in a similar manner.

Referring now to FIG. 3, it will be seen that plant pot 14 is attached to holder 10 by means of cord 44. Plant pot 14 includes a protruding base 68 for example a saucer-shaped member, and a container or pot 70 for a plant or flowers, for example. Pot 70 is securely attached to base 68 so that when the base is held to holder 10, the pot will be secured to the holder. Plant pot 14 is attached to holder 10 in a similar manner as that described in connection with attaching candle 12 to the holder. Cord 44 lies across the upper edge 72 of base 68 and holds the plant pot 14 to holder 10.

Figure 4:
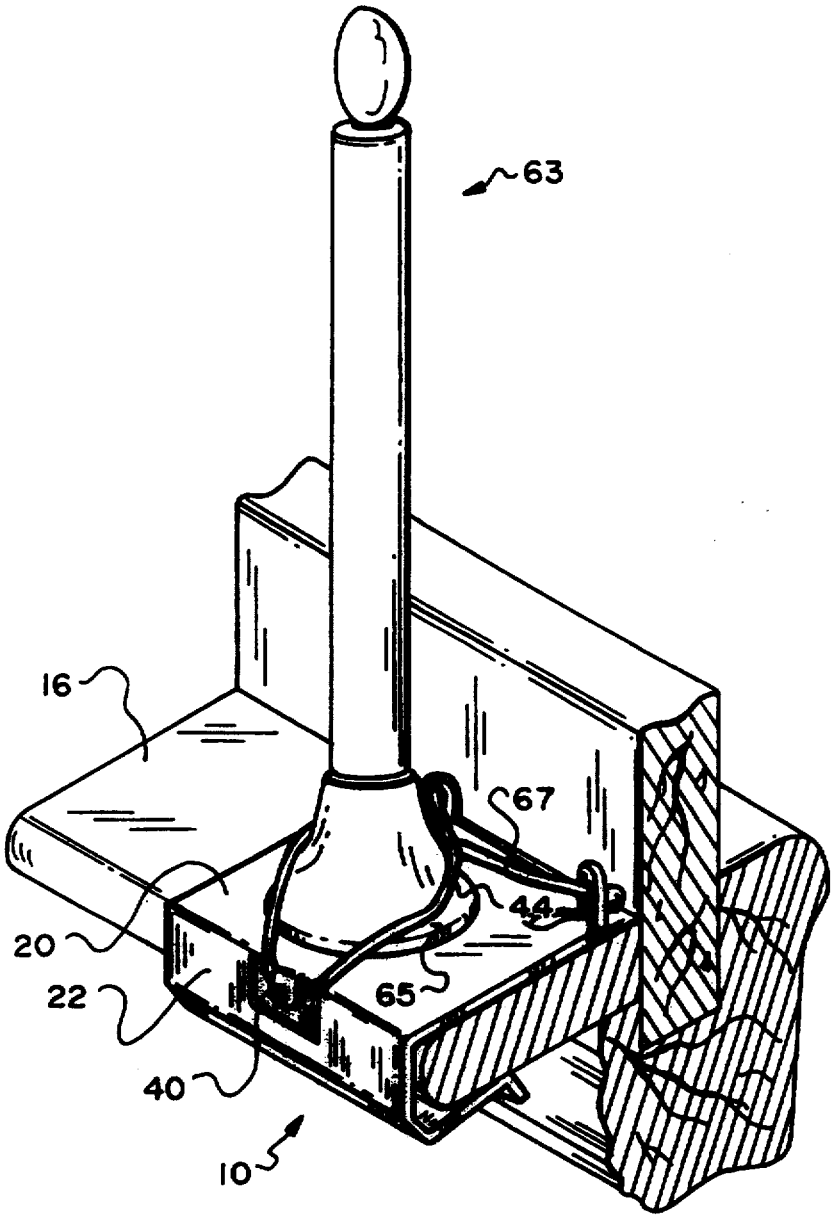
FIG. 4 is a perspective view of the holder of FIG. 1 supporting an electric candle on a window sill, the candle having a narrow base.

In cases where the object to be held to platform 20 has a narrow base, for example a candle 63 with a narrow base 65, cord 44 is twisted 180° to form a cross 67 as shown in FIG. 4. The narrow base 65 is inserted between the cross 67 and the portion of the cord 44 which is to be held by lip 40. Accordingly, when the chord 44 is passed under lip 40, the cross 67 is positioned between the narrow base and the outermost edge 25 of platform 20.

Figure 5:
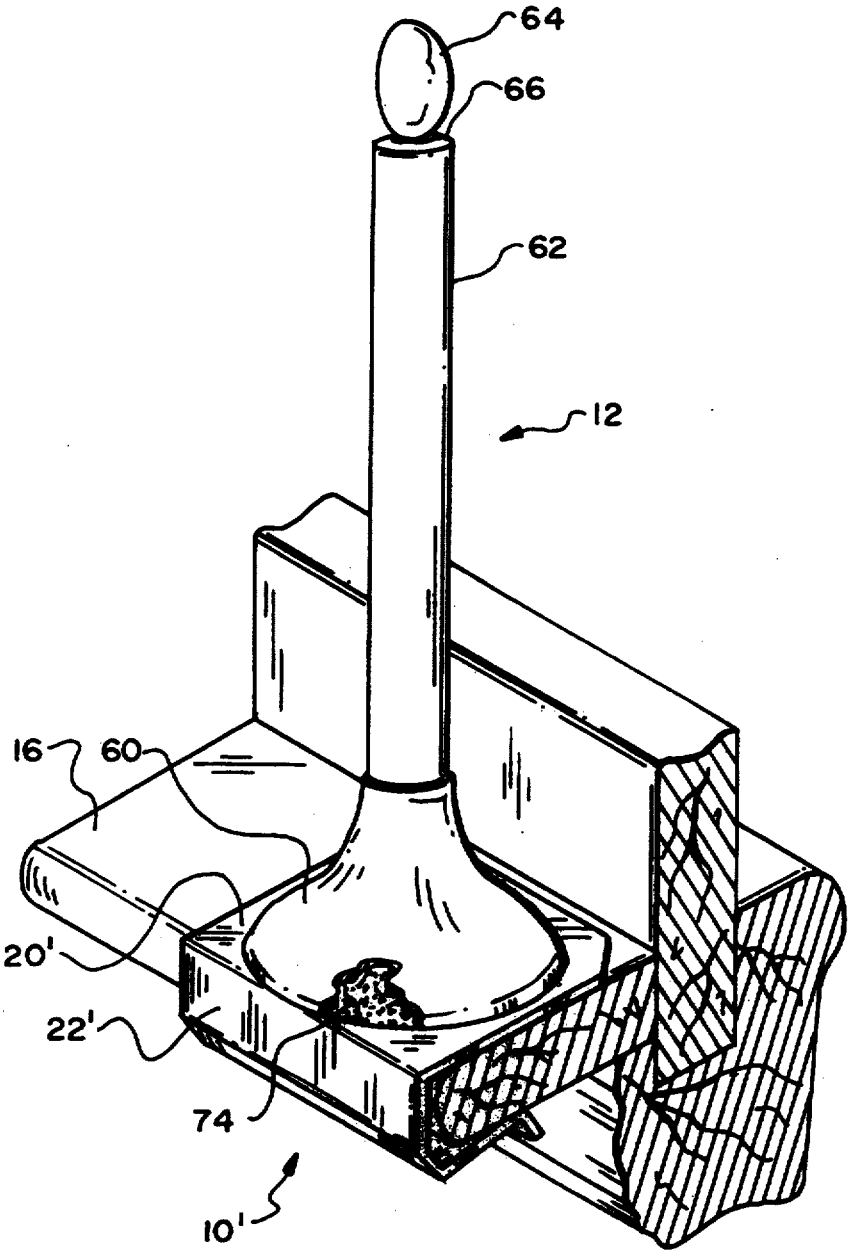
FIG. 5 is a perspective view of an alternate embodiment of the invention, an electric candle having a holder of the type shown in FIG. 2.
Figure 6:
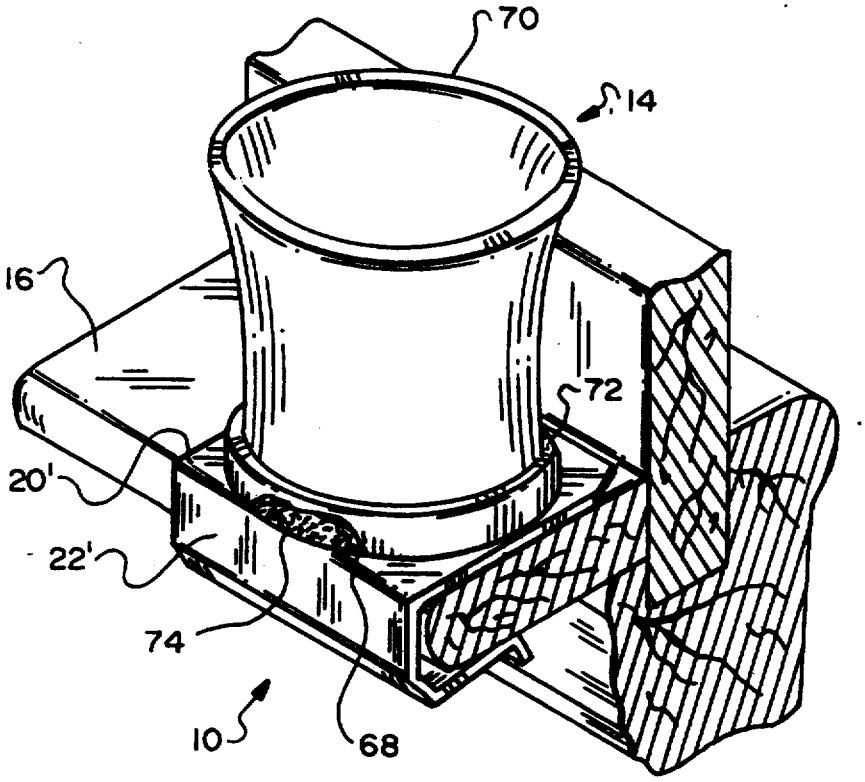
FIG. 6 is a perspective view of an alternate embodiment of the invention, a plant pot having a holder of the type shown in FIG. 3.

Although holder 10 is shown as being secured to window sill 16, it will be readily appreciated that the holder can be secure to a ledge, for example a narrow shelf or platform. In alternate embodiments of the invention, candle 12 and pot and saucer assembly 14 are secured to a platform 20 by means other than chord 44. For example, in the alternate embodiments shown in FIGS. 5 and 6, candle 12 and pot and saucer assembly 14 are provided with a holder 10' or are secured thereto by means of an adhesive 74. Holder 10' is similar to holder 10 with the exception that a supporting member 20' does not have upturned corners and an intermediate member 22' does not have either opening 38 or lip 40. In other embodiments, the candle and pot assembly are secured to holder 10 by other means, for example, supporting platform 20 is provided with a fixture for holding the base of the candle or plant pot or platform 20 is molded with an integral candle base or pot assembly base.

Since certain changes may be made in the foregoing disclosure without departing from the scope of the invention herein involved, it is intended that all matter contained in the above description and depicted in the accompanying drawings be construed in an illustrative and not in a limited sense.

What is claimed is:

1. A holder for holding objects on a window sill and the like, said holder comprising:

(a) a substantially J-shaped clip having an upper supporting portion, an intermediate portion and a lower gripping portion, said upper supporting portion and said intermediate portion being substantially perpendicular to one another, said lower gripping portion lying under said upper portion, a retainer formed in said intermediate portion; and (b) a stretchable cord, having first and second ends and an intermediate portion, said first end of said cord attached to a corner at an outer edge of said upper supporting portion, said second end attached to an opposite corner at said outer edge of said upper supporting member, said retainer sized and shaped to receive and hold said intermediate portion of said stretchable cord.

2. The holder as claimed in claim 1 wherein said corners of said upper supporting portion are turned upwardly to provide a fastening tab at each of said corners, one of each said first and second ends attached to one of each fastening tabs at said corners of said upper supporting portion.

3. The holder as claimed in claim 1 wherein the margin of a leading edge of said lower portion is bent downwardly to form a guideway, said bend defining a gripping surface.

4. A holder for holding and displaying objects on a window sill and the like, said holder comprising:

(a) a substantially J-shaped clip having an upper supporting portion, an intermediate portion and a lower gripping portion, said upper supporting portion and said intermediate portion being substantially perpendicular to one another, said lower gripping portion disposed under said upper portion, said supporting portion having an outer side and an inner side, said intermediate portion having an upper side and a lower side, said lower gripping surface having an outer side and an inner side, said inner side of said supporting portion adjacent said upper side of said intermediate portion, said lower side of said intermediate portion at said inner side of said gripping portion, a retainer provided in said intermediate portion; and (b) a stretchable cord, having first and second ends and an intermediate portion, said first end of said cord attached at one corner at said outer side of said upper supporting portion, said second end attached to an opposite corner at said outer side of said upper supporting member, said retainer sized and shaped to receive and hold said intermediate portion of said cord.

5. The holder as claimed in claim 4 wherein said one and opposite corners of said upper supporting portion are bent upwardly to form a tab at each of said corners, one of each said first and second ends of said stretchable cord secured at one of each tabs at said corners of said upper supporting portion.

6. The holder as claimed in claim 5 wherein the margin of said outer side of said lower portion is bent downwardly to form a guideway, said bend defining a gripping surface.

7. A holder for holding and displaying a candle assembly on a window sill, said candle assembly comprising a base and a candle, said candle attached to said base, said holder comprising:

(a) a substantially J-shaped clip having an upper supporting portion, an intermediate portion and a lower gripping portion, said upper supporting portion and said intermediate portion being substantially perpendicular to one another, said lower gripping portion lying under said upper portion, a retainer formed in said intermediate portion; and (b) a stretchable cord, having first and second ends and an intermediate portion, said first end of said cord attached to a corner at an outer edge of said upper supporting portion, said second end attached to an opposite corner at said outer edge of said upper supporting member, said retainer sized and shaped to receive said intermediate portion of said stretchable cord;

(c) said base positioned on said upper supporting portion, said cord passing over said base and securing said base to said upper supporting position.

8. The holder as claimed in claim 7 wherein said corners of said upper supporting portion are turned upwardly to provide a fastening tab at each said corners, one of each said first and second ends of said stretchable cord attached to one of each fastening tabs at said corners of said upper supporting portion, said intermediate portion of stretchable cord held in said retainer, a portion of said stretchable cord between said first end and said retainer lying across said base, a portion of said stretchable cord between said first end and said retainer lying across said base, said stretchable cord holding said base to said upper supporting portion of said holder.

9. The holder as claimed in claim 7 wherein a margin of a leading edge of said lower portion is bent downwardly to form a guideway.

10. A holder for holding objects on a window sill and the like, said holder comprising:

(a) a substantially J-shaped clip having an upper supporting portion, an intermediate portion and a lower gripping portion, said upper supporting portion and said intermediate portion being substantially perpendicular to one another, said lower gripping portion lying under said upper portion, said clip including a fastening means and a retainer means; and (b) a stretchable cord, said stretchable cord secured to said clip by said fastening means, said retainer means sized and shaped to receive and hold said stretchable cord for securing objects on said supporting portion.

* * * * *